US008845258B2

(12) United States Patent
Mori

(10) Patent No.: US 8,845,258 B2
(45) Date of Patent: Sep. 30, 2014

(54) MOLD SET FOR PAPER BINDING

(76) Inventor: Shohei Mori, Ishikawa (JP)

( * ) Notice: Subject to any disclaimer, the term of this patent is extended or adjusted under 35 U.S.C. 154(b) by 303 days.

(21) Appl. No.: 13/389,326

(22) PCT Filed: Aug. 11, 2010

(86) PCT No.: PCT/JP2010/005043

§ 371 (c)(1),
(2), (4) Date: Feb. 29, 2012

(87) PCT Pub. No.: WO2011/018897

PCT Pub. Date: Feb. 17, 2011

(65) Prior Publication Data

US 2012/0148372 A1 Jun. 14, 2012

(30) Foreign Application Priority Data

Aug. 12, 2009 (JP) ..... 2009-187040

(51) Int. Cl.
*B31F 5/02* (2006.01)
*B31F 1/10* (2006.01)
*B42B 5/00* (2006.01)

(52) U.S. Cl.
CPC ..... *B42B 5/00* (2013.01); *B42P 2241/26* (2013.01); *B31F 5/02* (2013.01)
USPC ..... 412/33; 412/9; 493/390

(58) Field of Classification Search
CPC ..... B31F 5/02; B31F 1/10
USPC ..... 412/33; 29/505, 506; 493/390
See application file for complete search history.

(56) References Cited

U.S. PATENT DOCUMENTS 3,106,139 A * 10/1963 Leopoldi ..... 493/390

FOREIGN PATENT DOCUMENTS

| | | | |
|---|---|---|---|
| DE | 1027499 | * | 4/1958 |
| JP | 1980-94863 | | 7/1980 |
| JP | 7-314591 | | 12/1995 |
| JP | 9-104183 | | 4/1997 |
| JP | 2000-153697 | | 6/2000 |
| JP | 2004-155537 | | 6/2004 |

OTHER PUBLICATIONS

International Search Report issued Sep. 14, 2010 in International (PCT) Application No. PCT/JP2010/005043.

* cited by examiner

*Primary Examiner* — Kyle Grabowski
(74) *Attorney, Agent, or Firm* — Wenderoth, Lind & Ponack, L.L.P.

(57) ABSTRACT

A paper sheet binding die set comprises first and second dies, each having an opposed surface comprising a plurality of tooth portions. The first and second dies face each other such that the first die and the second die are capable of meshing with each other. Each tooth portion of the first die comprises a valley-bottom portion, and a peak-top portion. Each tooth portion of the second die comprises a valley-bottom portion, a peak-top portion, and an inclined-surface portion extending at an incline from the valley-bottom portion to the peak-top portion. The peak-top portion of each of the plurality of tooth portions of the first die has a length so as to cover the inclined-surface portion of the corresponding tooth portion of the second die upon meshing of the first and second dies. The first and second dies pressurize the plurality of stacked paper sheets to bind them together.

7 Claims, 18 Drawing Sheets

(A)

(B)

MOLD SET FOR PAPER BINDING

BACKGROUND OF THE INVENTION

1. Technical Field

The present invention relates to a paper sheet binding die set capable of binding a plurality of paper sheets without use of metal staples, glues, strings, cords, or the like.

2. Background Art

Conventionally, many booklets and ledger sheets are created by binding with use of metal staples, glues, or the like. In a case of using the metal staples for binding, however, when a bound state is incomplete, there is a risk that end portions of the metal staple protrude.

Further, regarding disposal of booklets and ledger sheets that have become unnecessary, the booklets and ledger sheets are shredded by a shredder when necessary and then incinerated, or reused as recycled paper sheets in terms of resource conservation. In this context, in order to avoid damage to blades of the shredder, it is necessary to remove metal staples from paper sheets bound with the metal staples. Further, regarding paper sheets bound with glue, when the glue is a resin-based glue such as a hot-melt glue, it is necessary to cut off glued parts of the paper sheets so that noxious gases are not generated at the time of incineration.

Those operations require time and effort, which is reflected in costs such as a personnel cost. In order to overcome the problem, in other words, in order to bind paper sheets without use of metal staples or glues, for example, there have been disclosed a binding method and a binding apparatus in which, at the time of binding a plurality of paper sheets such as ledger sheets, moisture is supplied to each of the paper sheets, and then pressure is applied from above and below by binding members respectively provided with a series of projections and recesses (for example, refer to JP 3481300 B and JP 3502204 B).

However, by the binding method according to the technologies disclosed in Patent Literature 1 and Patent Literature 2, in which moisture is supplied to each of the paper sheets, and then pressure is applied from above and below by binding members respectively provided with a series of projections and recesses, bound parts are corrugated owing to the moisture. Thus, the method is not applicable to aesthetic articles such as a booklet and a brochure, and hence application of the method is limited to ledger sheets and the like. Further, in order to evenly supply moisture with respect to each of the paper sheets separately, it is necessary to install an elaborate and complex device for a preceding step of a binding process. Thus, in order to bind a large number of paper sheets, a scale of the device becomes larger in accordance therewith. Those are problems with this method.

SUMMARY OF THE INVENTION

It is an object of the present invention to provide a die set to be used, not only by general consumers but also by producers, in a paper sheet binding device for paper products, the die set being free from use of metal staples, glues, or the like, being excellent in safety, productivity, and cost performance, and facilitating disposal of paper sheets.

In order to achieve the above-mentioned object, according to the invention as described in claim 1, provided is a paper sheet binding die set, including a pair of dies arranged to face each other and having respective opposed surfaces provided with respective tooth portions capable of meshing with each other, the paper sheet binding die set being configured to bind a plurality of stacked paper sheets in a manner that the pair of dies pressurize the plurality of stacked paper sheets from both sides in a thickness direction and the respective tooth portions of the pair of dies are meshed with each other. The respective tooth portions formed on the respective opposed surfaces of the pair of dies each include a plurality of tooth portions each having a substantially triangular shape in cross section and a predetermined tooth width, and provided in series on a corresponding one of the respective opposed surfaces. Of the respective tooth portions formed on the respective opposed surfaces of the pair of dies, each of the plurality of tooth portions of one of the pair of dies includes, on one tooth-widthwise side or both tooth-widthwise sides, an inclined-surface portion inclined in a narrowing direction toward a peak-top portion of the each of the plurality of tooth portions of the one of the pair of dies, and at least a peak-top portion of each of the plurality of tooth portions of another of the pair of dies, which face the plurality of tooth portions of the one of the pair of dies, exists up to a position at which the peak-top portion of the each of the plurality of tooth portions of the another of the pair of dies covers a valley-bottom portion on the inclined-surface portion side of the each of the plurality of tooth portions of the one of the pair of dies.

According to the invention as described in claim 1, of the respective tooth portions formed on the respective opposed surfaces of the pair of dies, each of the plurality of tooth portions of one of the pair of dies includes, on one widthwise side or both widthwise sides, the inclined-surface portion inclined in a narrowing direction toward the peak-top portion of the each of the plurality of tooth portions of the one of the pair of dies, and at least the peak-top portion of each of the plurality of tooth portions of another of the pair of dies, which face the plurality of tooth portions of the one of the pair of dies, exists up to a position at which the peak-top portion of the each of the plurality of tooth portions of the another of the pair of dies covers the valley-bottom portion on the inclined-surface portion side of the each of the plurality of tooth portions of the one of the pair of dies. Thus, regarding the respective tooth portions of the pair of dies facing each other, an end portion of the peak-top portion on the inclined-surface portion side of the each of the plurality of tooth portions of the one of the pair of dies falls within a width of the peak-top portion of the each of the plurality of tooth portions of the another of the pair of dies. When the respective tooth portions of the pair of dies facing each other are meshed with each other, the peak-top portion on the inclined-surface portion side of the each of the plurality of tooth portions of the one of the pair of dies undergoes meshing on the end portion side within the width of the peak-top portion of the each of the plurality of tooth portions of the another of the pair of dies. In this way, the valley-bottom portion on the inclined-surface portion side of the each of the plurality of tooth portions of the one of the pair of dies and the peak-top portion of the each of the plurality of tooth portions of the another of the pair of dies are meshed with each other.

When a plurality of stacked paper sheets are pressurized from both sides in a thickness direction with the pair of dies as described above and the respective tooth portions of the pair of dies are meshed with each other, with regard to the end portions of the peak-top portions of each of the respective tooth portions, at which the plurality of paper sheets are most liable to be torn, the peak-top portion on the inclined-surface portion side undergoes meshing on the end portion side within the width of the peak-top portion of the each of the plurality of tooth portions of the another of the pair of dies. Therefore, the end portions of the peak-top portions are not meshed with each other in a manner of facing each other. Thus, the paper sheets are suppressed from being torn even through application of high pressure. Further, the end portion of the peak-top portion of the each of the plurality of tooth portions of the one of the pair of dies, which is to undergo meshing within the width of the peak-top portion of the each of the plurality of tooth portions of the another of the pair of dies, is formed as the inclined-surface portion. Thus, the inclined-surface portion buffers pressure generated when meshing the respective tooth portions of the pair of dies with each other. Also with this, the paper sheets are suppressed from being torn.

With this, at the time of binding the plurality of paper sheets, the plurality of paper sheets can be compressed through application of a large force to the pair of dies while suppressing the paper sheets from being torn, and a large binding force is obtained at the compressed portions of the plurality of paper sheets. Thus, the plurality of paper sheets can be reliably bound while being suppressed from being torn.

Further, the end portion of the valley-bottom portion on the inclined-surface portion side of the each of the plurality of tooth portions of the one of the pair of dies is meshed with the peak-top portion of the each of the plurality of tooth portions of the another of the pair of dies. As a result, the plurality of paper sheets are compressed between the end portions of the peak-top portion of the respective tooth portions of the pair of dies and between the end portions of the valley-bottom portion of the respective tooth portions of the pair of dies. Thus, a large binding force is obtained at the compressed portions of the plurality of paper sheets, and hence the plurality of paper sheets can be reliably bound.

According to the invention as described in claim 2, in claim 1, the opposed surface provided with the tooth portions of at least one of the pair of dies, each include a flat surface substantially flush with the valley-bottom portion of each of the plurality of tooth portions of a corresponding one of the pair of dies, the flat surface being formed on the one widthwise side or both the widthwise sides of the each of the plurality of tooth portions of the corresponding one of the pair of dies.

According to the invention as described in claim 2, the opposed surface provided with the tooth portions of at least one of the pair of dies, each include the flat surface substantially flush with the valley-bottom portion of each of the plurality of tooth portions of a corresponding one of the pair of dies, the flat surface being formed on the one widthwise side or both the widthwise sides of the each of the plurality of tooth portions of the corresponding one of the pair of dies. In a case where a large number of paper sheets are stacked, it is necessary to apply higher pressure from the respective tooth portions, but excessive pressure may cause the paper sheets to be torn, with the result that a binding strength may be reduced. However, when the plurality of stacked paper sheets are pressed with the flat surfaces, excessive pressure to the plurality of paper sheets from the respective tooth portions can be regulated.

According to the invention as described in claim 3, in claim 1 or 2, both widthwise end portions of the peak-top portion of the each of the plurality of tooth portions of the corresponding one of the pair of dies and both widthwise end portions of the valley-bottom portion of the each of the plurality of tooth portions of the corresponding one of the pair of dies are each formed into a curved-surface shape.

According to the invention as described in claim 3, both the widthwise end portions of the peak-top portion of the each of the plurality of tooth portions of the corresponding one of the pair of dies and both the widthwise end portions of the valley-bottom portion of the each of the plurality of tooth portions of the corresponding one of the pair of dies are each formed into a curved-surface shape. Thus, the plurality of paper sheets are effectively prevented or suppressed from being torn by both the widthwise end portions of the peak-top portion of the each of the plurality of tooth portions of the corresponding one of the pair of dies and both the widthwise end portions of the valley-bottom portion of the each of the plurality of tooth portions of the corresponding one of the pair of dies, at which extremely high-pressure is applied to the plurality of paper sheets when the respective tooth portions are meshed with each other.

According to the invention as described in claim 4, in any one of claims 1, 2, and 3, the one of the pair of dies has a gear shape, and the another of the pair of dies has a linear shape.

According to the invention as described in claim 4, the one of the pair of dies has a gear shape, and the another of the pair of dies has a linear shape. Thus, the plurality of paper sheets can be bound through rotation of the gear-shaped die and movement of the gear-shaped die or the linear-shaped die. In this way, the pair of dies can pressurize the plurality of paper sheets through reciprocating movement. Further, contacts of meshing are partial, and hence surface pressure is considerably reduced. Still further, variation of ranges of points to be bound can be easily coped with.

In addition, the pair of dies generates less noise at the time of pressing, and enables compact devices to perform binding. Thus, the pair of dies can be utilized as dies for manual binding devices and inner binding devices for on-demand digital printers each having a small space therein.

Advantageous Effects of Invention

According to the paper sheet binding die set of the present invention, at the time of binding a plurality of paper sheets, the plurality of paper sheets can be compressed through application of a large force to the pair of dies while suppressing the plurality of paper sheets from being torn, and a large binding force is obtained at the compressed portions of the plurality of paper sheets. Thus, the plurality of paper sheets can be reliably bound with a large binding force while being suppressed from being torn.

The paper sheet binding die set according to the present invention can be used not only for binding magazines, booklets, brochures, free newspapers, bulletins, commemorative issues, booklet leaflets, booklet newspapers, and notebooks, but also for binding parts to be bound of paper bags, paper carton boxes, and paper cardboard boxes.

Further, the paper sheet binding die set according to the present invention is capable of binding, in addition to paper sheets, for example, a metal sheet member obtained by laminating a plastic film, an aluminum film, and the like on a paper sheet, and hence is applicable to binding of the metal sheet member obtained by laminating a plastic film, an aluminum film, and the like on a paper sheet.

BRIEF DESCRIPTION OF THE DRAWINGS

FIG. 7(A) is an explanatory diagram illustrating a state in which an upper die shifts to one side, and FIG. 7(B) an explanatory diagram illustrating a state in which the upper die shifts to another side.

DETAILED DESCRIPTION OF THE INVENTION

Figure 1:
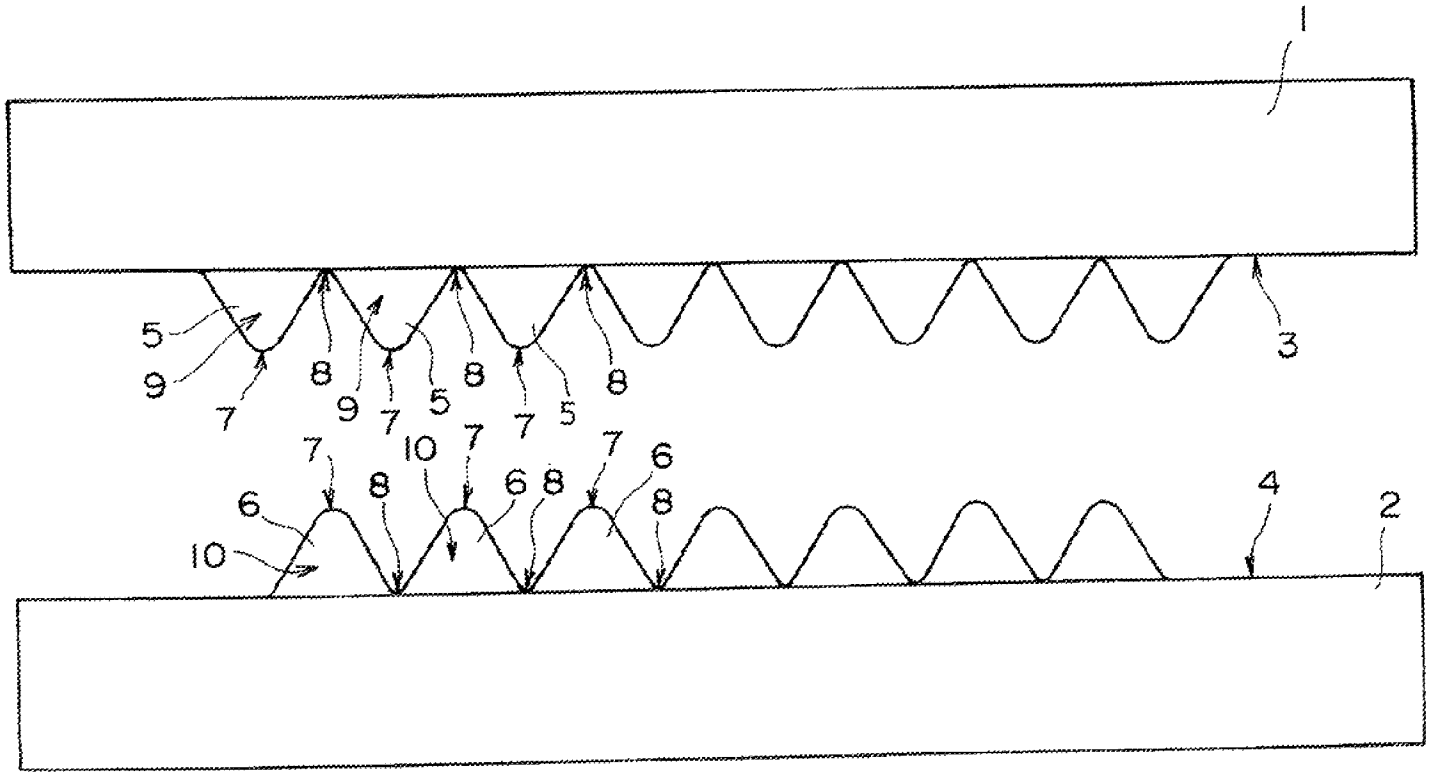
FIG. 1 is a front view illustrating a paper sheet binding die set according to a first embodiment of the present invention.

Next, description is made of a paper sheet binding die set according to an exemplary embodiment of the present invention.

The paper sheet binding die set according to the present invention includes a pair of dies arranged to face each other and having respective opposed surfaces provided with respective tooth portions capable of meshing with each other.

The tooth portions formed on the opposed surface of each of the pair of dies each have a substantially triangular shape in cross section and a predetermined width, and a plurality of tooth portions are provided in series on the opposed surface. Regarding the tooth portions, it is preferred that, when the respective tooth portions of the pair of dies are meshed with each other, a gap be formed between a peak-top portion of each of the tooth portions of one of the dies and a valley-bottom portion of each of the tooth portions of another of the dies. The gap can be formed by forming the peak-top portion of the tooth portion to have a curved surface having a curvature larger than that of the valley-bottom portion.

Of the tooth portions formed as described above, the tooth portion of the one of the dies includes, on one widthwise side or both widthwise sides, an inclined-surface portion inclined in a narrowing direction toward the peak-top portion of the tooth portion. At least the peak-top portion of the tooth portion of the another of the dies, which faces the tooth portion of the one of the dies, exists up to a position at which the peak-top portion of the tooth portion of the another of the dies covers the valley-bottom portion on the inclined-surface portion side of the tooth portion of the one of the dies.

The inclined-surface portion may be provided on one widthwise side of the tooth portion of the one of the dies, and the inclined-surface portion may further be provided on one widthwise side of the tooth portion of the another of the dies, which is situated on a diagonal line with respect to the inclined-surface portion of the tooth portion of the one of the dies facing the tooth portion of the another of the dies. Alternatively, the inclined-surface portion may be provided on both the widthwise sides of the tooth portion of the one of the dies. Inclination angles of the inclined-surface portions are not particularly limited.

Further, the peak-top portion of the tooth portion of the another of the dies, which exists up to the position at which the peak-top portion of the tooth portion of the another of the dies covers the valley-bottom portion on the inclined-surface portion side of the tooth portion of the one of the dies, is not limited in position as long as the peak-top portion covers the valley-bottom portion on the inclined-surface portion side of the tooth portion of the one of the dies. For example, the peak-top portion of the tooth portion of the another of the dies may exist partway up to the valley-bottom portion on the inclined-surface portion side of the tooth portion of the one of the dies, or may exist up to a position beyond the valley-bottom portion on the inclined-surface portion side.

Still further, it is preferred that, on the opposed surface provided with the tooth portions of at least one of the pair of dies facing each other, a flat surface substantially flush with the valley-bottom portion of each of the tooth portions be formed on the one widthwise side or both the widthwise sides of each of the tooth portions. Yet further, it is preferred that, on the opposed surface provided with the tooth portions of at least one of the pair of dies facing each other, a flat surface substantially flush with the valley-bottom portion of each of the tooth portions be formed on the one side or both the sides in a direction in which the tooth portions are provided in series. Yet further, it is preferred that both widthwise end portions of the peak-top portion of the tooth portion and both widthwise end portions of the valley-bottom portion of the tooth portion be formed into a curved-surface shape. Yet further, it is preferred that side surfaces of the tooth portion, in other words, corner portions formed of the inclined-surface portion and the surface portion opposite to the inclined-surface portion also be each formed into a curved-surface shape.

In the following, detailed description is made of a paper sheet binding die set according to specific embodiments of the present invention with reference to the drawings.

Figure 2:
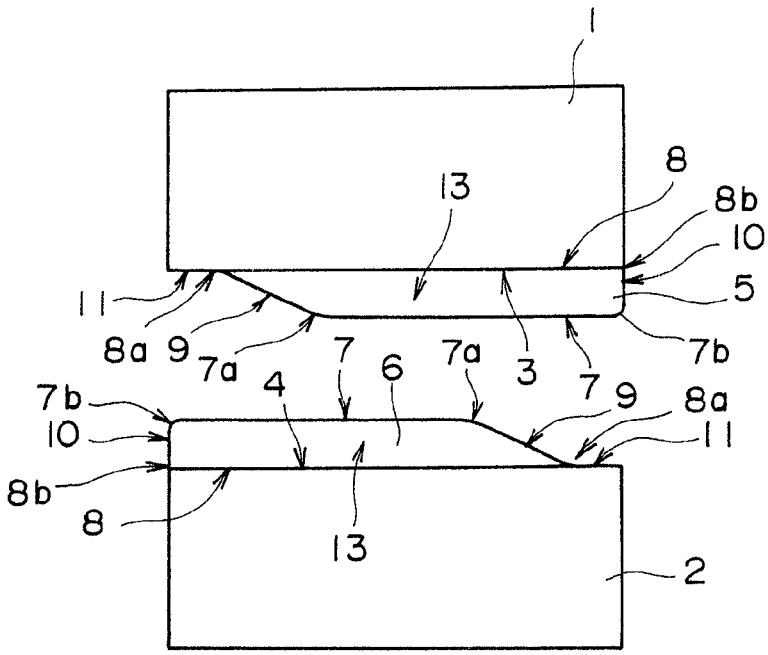
FIG. 2 is a right-side view of FIG. 1.
Figure 3:
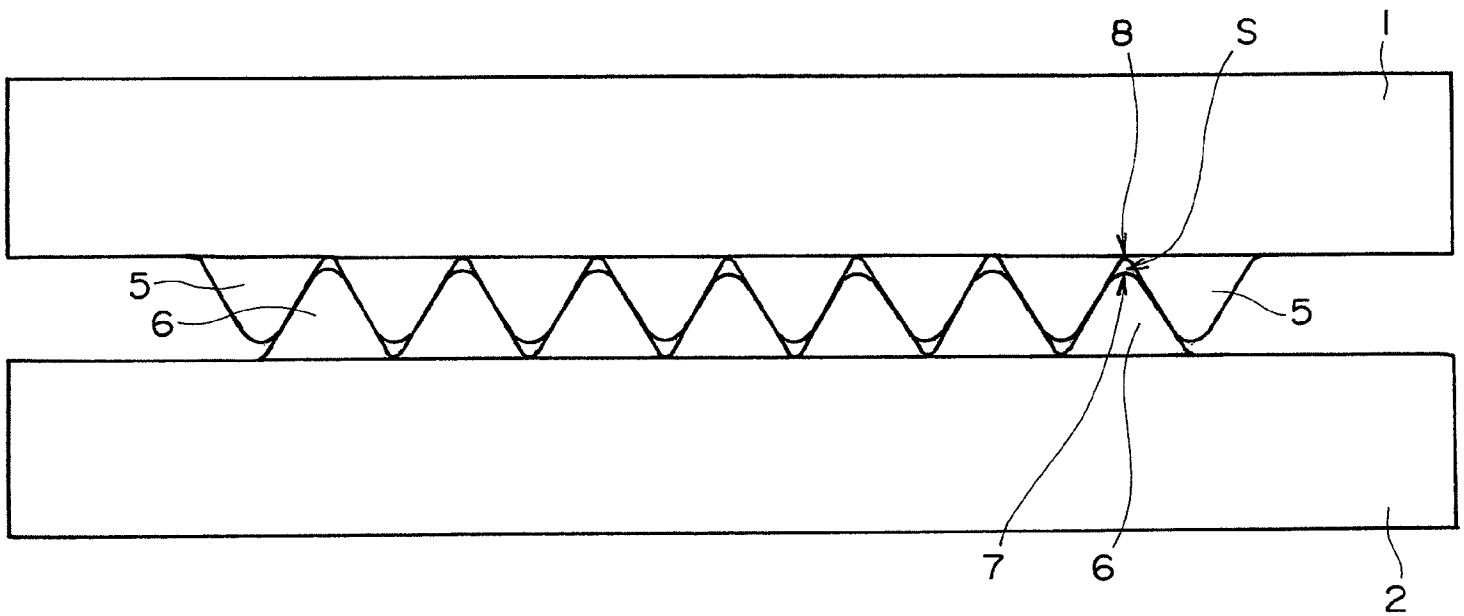
FIG. 3 is a front view illustrating a state in which tooth portions of a pair of dies according to the first embodiment are meshed with each other.
Figure 4:
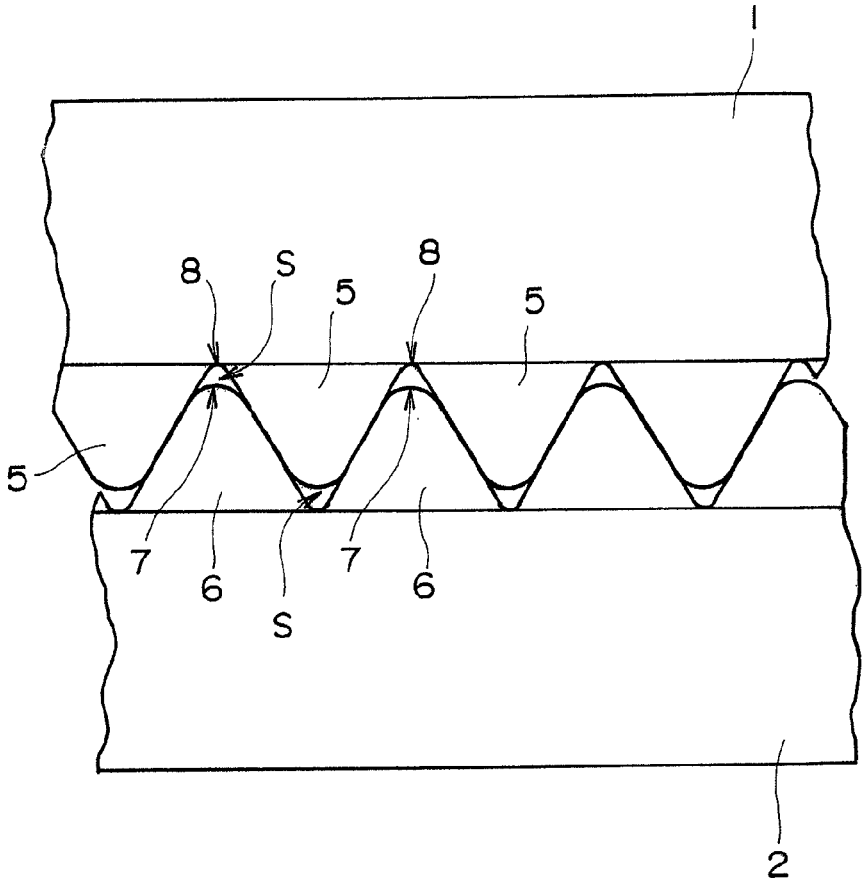
FIG. 4 is a partially enlarged view of FIG. 3.
Figure 5:
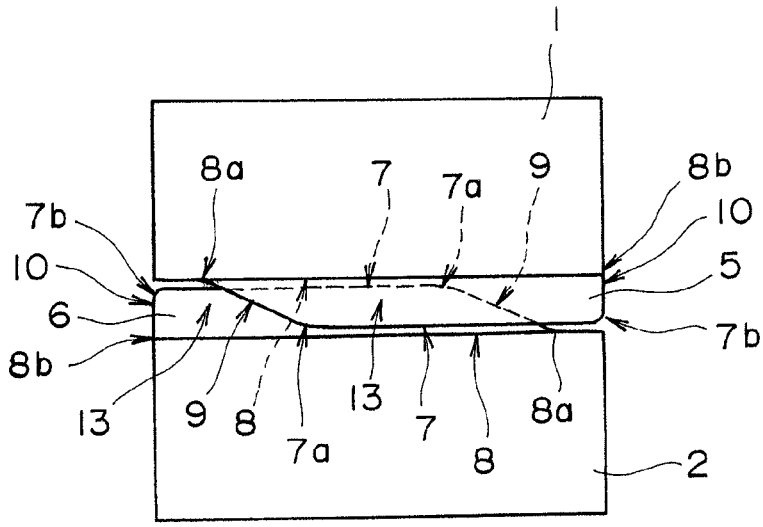
FIG. 5 is a right-side view of FIG. 3.
Figure 6:
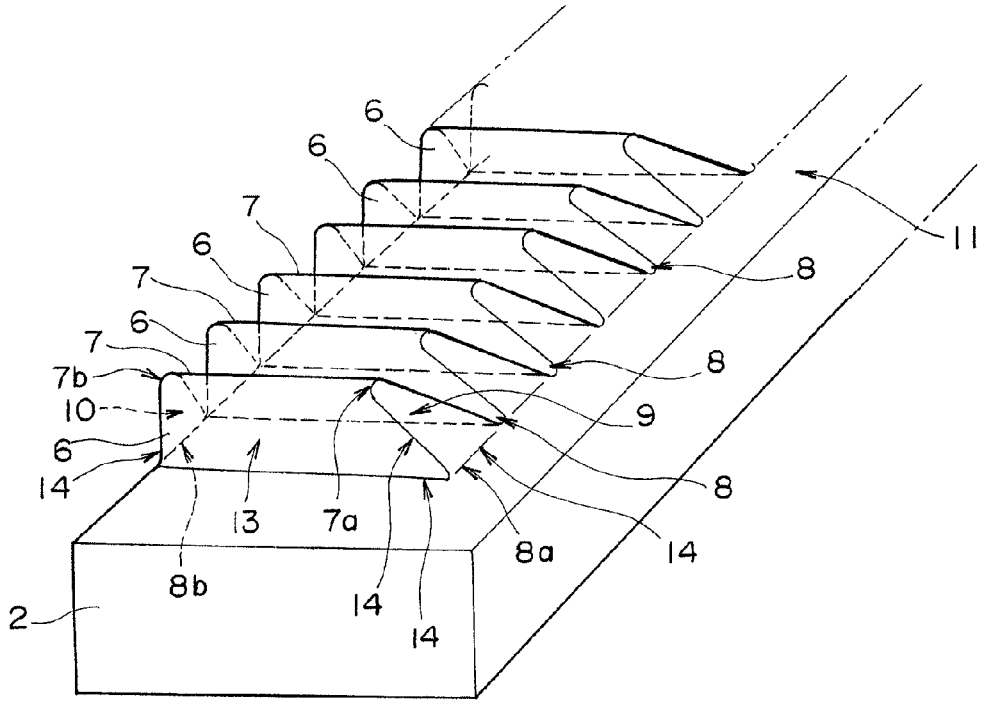
FIG. 6 is a partially-omitted enlarged perspective view of the tooth portions of the die according to the first embodiment.
Figure 7:
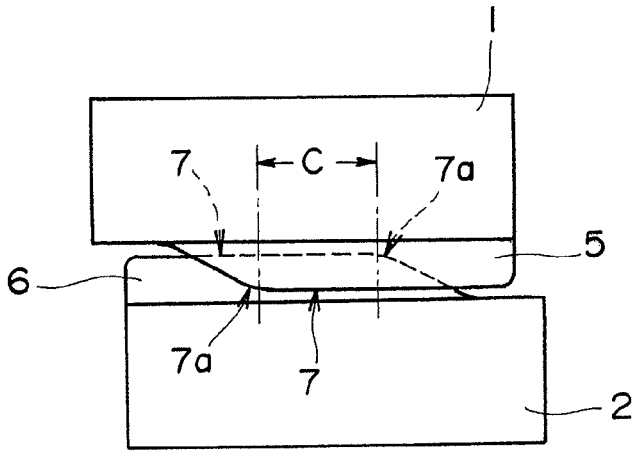
FIGS. 7(A) and 7(B) illustrate a meshing state of the tooth portions under a state in which axes of the pair of dies according to the first embodiment shift with respect to each other.
Figure 7:
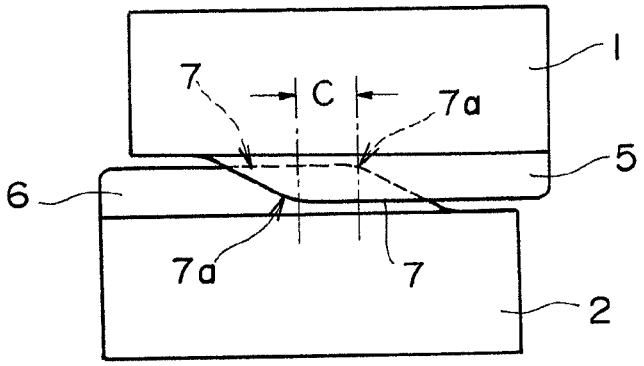
Figure 8:
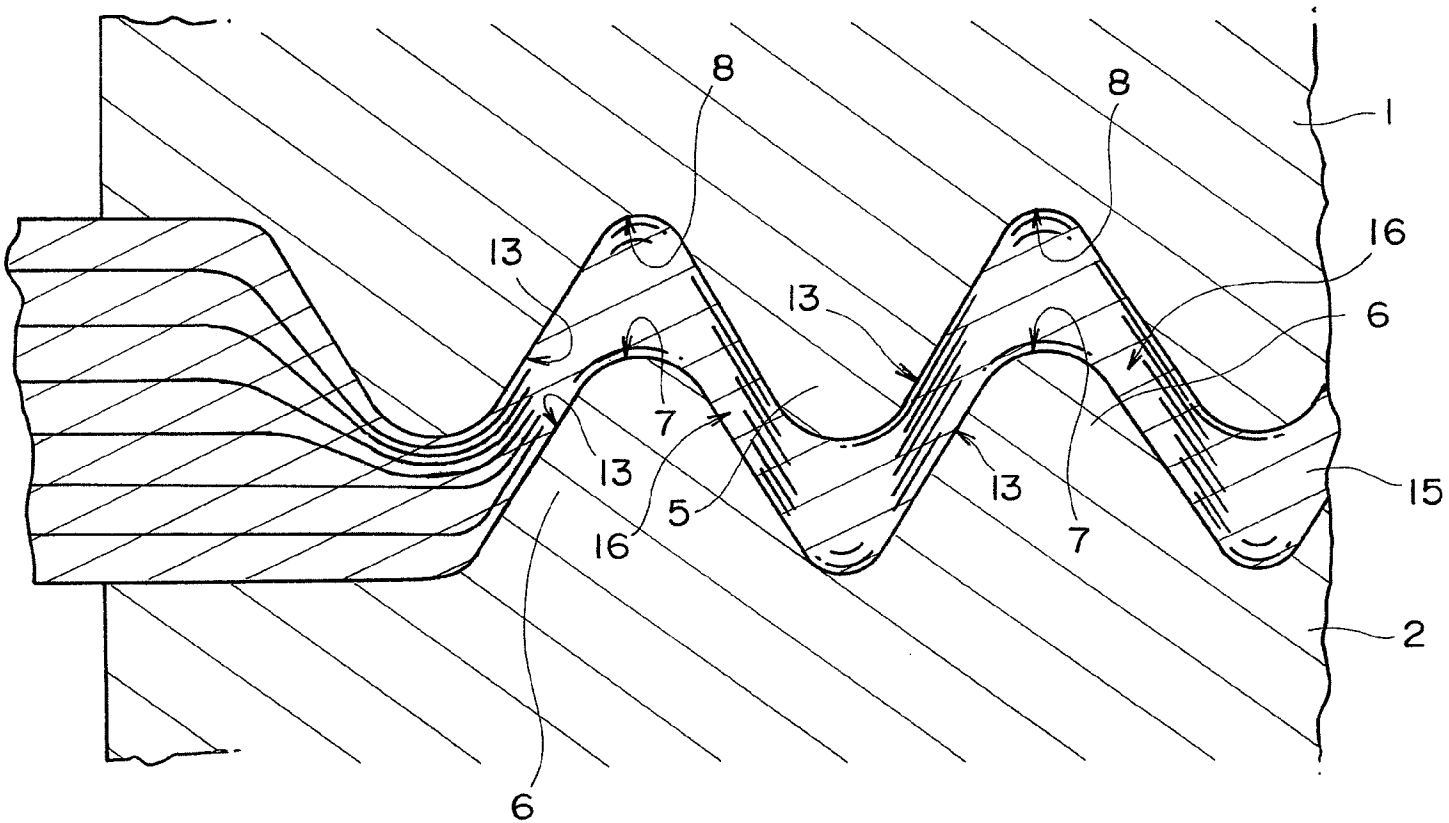
FIG. 8 is a partially enlarged sectional view illustrating a state in which paper sheets are compressed with the dies according to the first embodiment.
Figure 9:
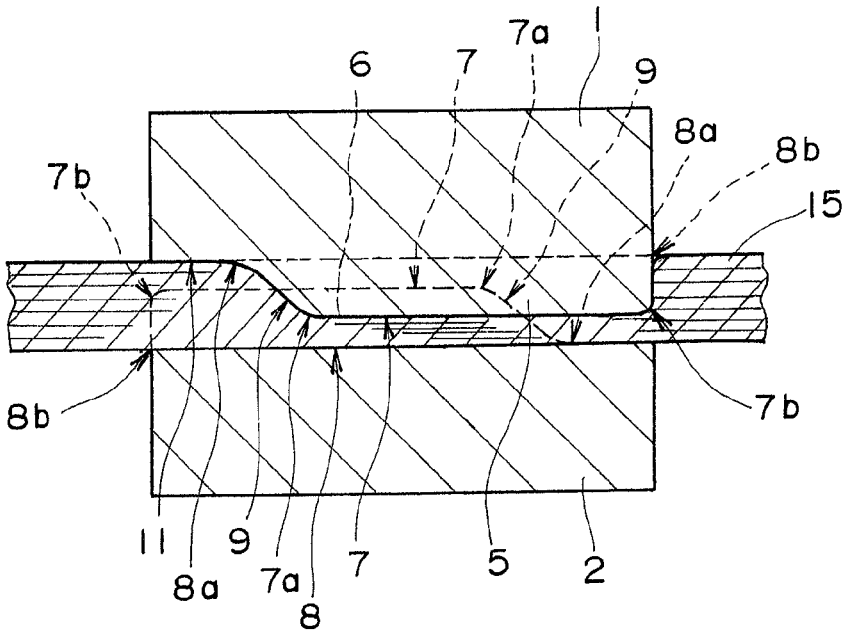
FIG. 9 is a vertical sectional view taken along a width direction of the tooth portions, illustrating the state in which paper sheets are compressed with the dies according to the first embodiment.

FIGS. 1 to 9 illustrate a paper sheet binding die set according to a first embodiment of the present invention. FIG. 1 is a front view of the paper sheet binding die set according to the first embodiment. FIG. 2 is a right-side view of FIG. 1. FIG. 3 is a front view illustrating a state in which tooth portions of a pair of dies according to the first embodiment are meshed with each other. FIG. 4 is a partially enlarged view of FIG. 3. FIG. 5 is a right-side view of FIG. 3. FIG. 6 is a partially-omitted enlarged perspective view of the tooth portions of the die according to the first embodiment. FIG. 7 illustrate a meshing state of the tooth portions under a state in which axes of the pair of dies according to the first embodiment shift with respect to each other. FIG. 7(A) is an explanatory diagram illustrating a state in which an upper die shifts to one side, and FIG. 7(B) an explanatory diagram illustrating a state in which the upper die shifts to another side. FIG. 8 is a partially enlarged sectional view illustrating a state in which paper sheets are compressed with the dies according to the first embodiment. FIG. 9 is a vertical sectional view taken along a width direction of the tooth portions, illustrating the state in which paper sheets are compressed with the dies according to the first embodiment.

The paper sheet binding die set according to the first embodiment includes a pair of dies 1 and 2 arranged to face each other. Opposed surfaces 3 and 4 of the dies 1 and 2 are respectively provided with tooth portions 5 and 6 capable of meshing with each other. The tooth portions 5 and 6 each have a substantially triangular shape in cross section and a predetermined width, and a plurality of tooth portions are provided in series on a corresponding one of the respective opposed surfaces.

In the first embodiment, peak-top portions 7 and valley-bottom portions 8 are formed into a curved surface in each of the tooth portions 5 and 6, and the curved surface of each of the peak-top portions 7 has a curvature larger than the curved surface of each of the valley-bottom portions 8. With this, when the tooth portions 5 and 6 are meshed with each other, a gap S is formed between the peak-top portion 7 of the tooth portion 5 of the one die 1 and the valley-bottom portion 8 of the tooth portion 6 of the another die (refer to FIGS. 2 and 3).

Of the tooth portions 5 and 6 formed as described above, in the first embodiment, the tooth portion 5 of the one die 1 includes, on one widthwise side, an inclined-surface portion 9 inclined in a narrowing direction toward the peak-top portion 7 of the tooth portion 5. Further, the tooth portion 6 of the die 2 includes, on one widthwise side, an inclined-surface portion 9, which is formed on a diagonal side with respect to the above-mentioned inclined-surface portion 9 of the tooth portion 5 of the die 1. Inclination angles of the inclined-surface portions 9 are not particularly limited.

Further, the peak-top portion 7 of the tooth portion 5 of the die 1 exists up to a position at which the peak-top portion 7 of the tooth portion 5 of the die 1 covers the valley-bottom portion 8 on the inclined-surface portion 9 side of the tooth portion 6 of the die 2. In addition, the peak-top portion 7 of the tooth portion 6 of the die 2 exists up to a position at which the peak-top portion 7 of the tooth portion 6 of the die 2 covers the valley-bottom portion 8 on the inclined-surface portion 9 side of the tooth portion 5 of the die 1.

The peak-top portion 7 of the tooth portion 6 (5) of the die 2 (1), which exists up to the position at which the peak-top portion 7 of the tooth portion 6 (5) of the die 2 (1) covers the valley-bottom portion 8 on the inclined-surface portion 9 side of the tooth portion 5 (6) of the die 1 (2), is not limited in position as long as the peak-top portion 7 covers the valley-bottom portion 8 on the inclined-surface portion 9 side of the tooth portion 5 (6) of the die 1 (2). In the first embodiment, the peak-top portion 7 of the tooth portion 6 (5) of the die 2 (1) exists up to a position beyond an end portion 8*a* of the valley-bottom portion 8 on the inclined-surface portion 9 side of the tooth portion 5 (6) of the die 1 (2).

Further, a surface portion 10 opposite to the inclined-surface portion 9 on the one widthwise side of each of the tooth portions 5 and 6 of the dies 1 and 2 may include a perpendicular surface or an inclined surface as long as the peak-top portion 7 of the tooth portion 5 (6) of the die 1 (2) exists up to the position at which the peak-top portion 7 of the tooth portion 5 (6) of the die 1 (2) covers the valley-bottom portion 8 on the inclined-surface portion 9 side of the tooth portion 6 (5) of the die 2 (1). In the first embodiment, the opposite surface portion 10 is a perpendicular surface.

Further, in the first embodiment, on each of the opposed surfaces 3 and 4 of the pair of dies 1 and 2 facing each other, on which the respective tooth portions 5 and 6 are formed, a flat surface 11 substantially flush with the valley-bottom portion 8 of each of the tooth portions 5 and 6 is formed on the inclined-surface portion 9 side of each of the tooth portions 5 and 6 and on both sides in a direction in which the tooth portions 5 and 6 are provided in series.

Still further, in the first embodiment, end portions 7*a* and 7*b* on both widthwise sides of the peak-top portion 7 and end portions 8*a* and 8*b* on both widthwise sides of the valley-bottom portion 8 of each of the tooth portions 5 and 6 are each formed into a curved-surface shape. In addition, side surfaces of each of the tooth portions 5 and 6, in other words, corner portions 14 formed of the inclined-surface portion 9, the opposite surface portion 10, and side-wall surface portions 13 are also each formed into a curved-surface shape (refer to FIG. 6).

The paper sheet binding die set including the pair of dies 1 and 2 formed as described above binds a plurality of stacked paper sheets as follows.

A plurality of stacked paper sheets 15 are strongly pressurized from both sides in a thickness direction with the pair of dies 1 and 2, and the tooth portions 5 and 6 of the dies 1 and 2 are meshed with each other. In this manner, the plurality of paper sheets 15 are compressed by the tooth portions 5 and 6, and thus are strongly pressurized in a vertical direction between the side-wall surface portions 13 of the tooth portions 5 and 6. With this, the plurality of stacked paper sheets 15 is strongly rubbed against each other. As a result, fibers on surfaces of the paper sheets 15 are exposed and twined with each other, and then compressed. In this way, compressed portions 16 are united, with the result that the stacked paper sheets 15 are firmly bound to each other. Then, surplus fibers of the paper sheets 15, which are formed as a result of the compression, are collected into the gap S to be formed between the peak-top portion 7 of the tooth portion 5 of the die 1 and the valley-bottom portion 8 of the tooth portion 6 of the die 2. As a result, a binding strength with respect to the paper sheets 15 at this part is prevented from being deteriorated (refer to FIG. 8).

In the first embodiment, the tooth portion 5 (6) of the die 1 (2) includes, on the one widthwise side, the inclined-surface portion 9 inclined in the narrowing direction toward the peak-top portion 7 of the tooth portion 5 (6). The peak-top portion 7 of the tooth portion 6 (5) of the die 2 (1), which faces the tooth portion 5 (6), exists up to a position beyond the end portion 8*a* of the valley-bottom portion 8 on the inclined-surface portion 9 side of the tooth portion 5 (6) of the die 1 (2). Therefore, the end portion 7*a* of the peak-top portion 7 on the inclined-surface portion 9 side of the tooth portion 5 (6) of the die 1 (2) falls within a width of the peak-top portion 7 of the tooth portion 6 (5) of the die 2 (1). When the tooth portions 5 and 6 of the dies 1 and 2 are meshed with each other, the peak-top portion 7 on the inclined-surface portion 9 side of the tooth portion 5 (6) of the die 1 (2) undergoes meshing on the end portion 7*a* side within the width of the peak-top portion 7 of the tooth portion 6 (5) of the die 2 (1). As a result, the end portion 8*a* of the valley-bottom portion 8 on the inclined-surface portion 9 side of the tooth portion 5 (6) of the die 1 (2) is meshed with the peak-top portion 7 of the tooth portion 6 (5) of the die 2 (1) (refer to FIG. 5).

Figure 10:
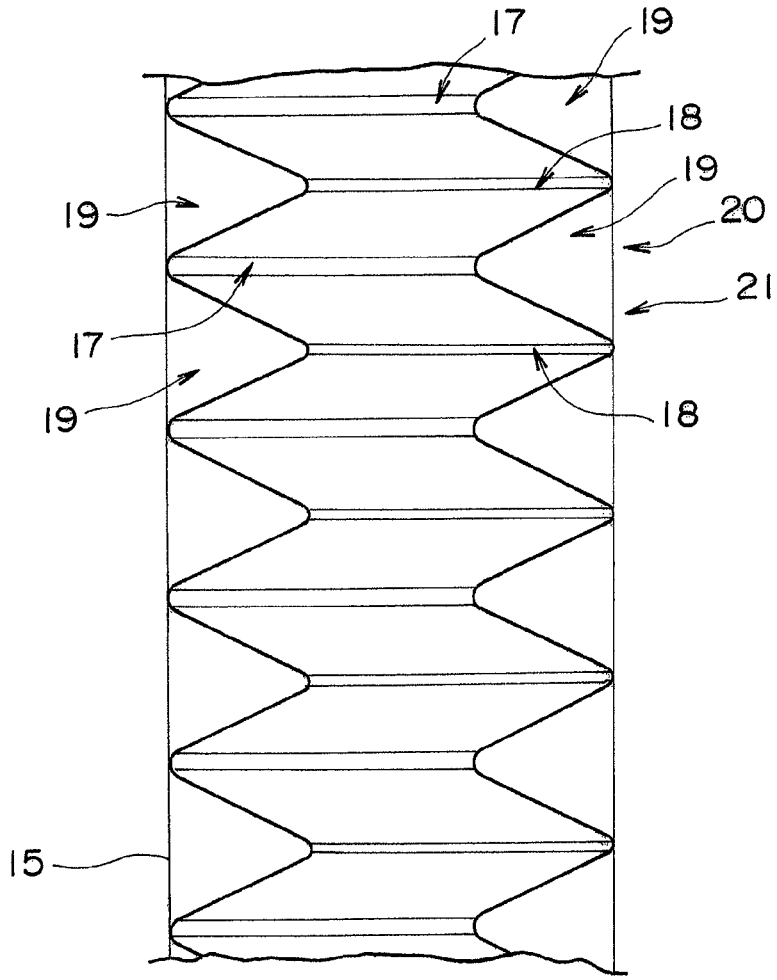
FIG. 10 is an explanatory diagram of compression imprints on paper sheets compressed and bound with the pair of dies according to the first embodiment.

In the plurality of paper sheets 15 compressed with the dies 1 and 2 as described above, bound portions 21 each marked by a compression imprint 20 are formed. In the compression imprint 20, peak portions 17 and valley portions 18 are formed, and an inclined surface 19 is formed on one side of each of the peak portions 17 while another inclined surface 19 is formed on one side of each of the valley portions 18, which is an opposite side of the inclined surface 19 formed on each of the peak portions 17(refer to FIG. 10).

When the plurality of stacked paper sheets 15 are pressurized from both the sides in the thickness direction with the dies 1 and 2 formed as described above and the tooth portions 5 and 6 of the dies 1 and 2 are meshed with each other, with regard to the end portions 7*a* and 7*b* of the respective peak-top portions 7 of the tooth portions 5 and 6, at which the paper sheets 15 are most liable to be torn, the peak-top portion 7 on the inclined-surface portion 9 side of the tooth portion 5 (6) of the one die 1 (2) undergoes meshing on the end portion 7*a* side and the end portion 7*b* side within the width of the peak-top portion 7 of the tooth portion 6 (5) of the another die 2 (1). Therefore, the end portions 7*a* and 7*b* of the respective peak-top portions 7 of the tooth portions 5 and 6 are not meshed with each other in a manner of facing each other. Thus, the paper sheets 15 are suppressed from being torn even through application of high pressure. Further, the end portions 7*a* and 7*b* of the peak-top portion 7 of the tooth portion 5 (6) of the one die 1 (2), which is to undergo meshing within the width of the peak-top portion 7 of the tooth portion 6 (5) of the another die 2 (1), are formed as the inclined-surface portions 9. Thus, the inclined-surface portion 9 buffers pressure generated when meshing the tooth portions 5 and 6 of the dies 1 and 2 with each other. Also with this, the paper sheets 15 are suppressed from being torn.

With this, at the time of binding the plurality of paper sheets 15, the plurality of paper sheets 15 can be compressed through application of a large force to the dies 1 and 2 while suppressing the paper sheets 15 from being torn, and a large binding force is obtained at the compressed portions 16 of the paper sheets 15. Thus, the plurality of paper sheets 15 can be reliably bound while being suppressed from being torn. Further, the end portion 8*a* of the valley-bottom portion 8 on the inclined-surface portion 9 side of the tooth portion 5 (6) of the one die 1 (2) is meshed with the peak-top portion 7 of the tooth portion 6 (5) of the another die 2 (1). As a result, the paper sheets 15 are compressed between the end portions 7*a* and 7*b* of the peak-top portion 7 of the tooth portions 5 and 6 of the dies 1 and 2 and between the end portions 8*a* and 8*b* of the valley-bottom portion 8 of the tooth portions 5 and 6 of the dies 1 and 2. Thus, a large binding force is obtained at the compressed portions 16 of the paper sheets 15, and hence the plurality of paper sheets 15 can be reliably bound (refer to FIG. 9).

Further, in the first embodiment, the end portion 7*a* of the peak-top portion 7 on the inclined-surface portion 9 side of the tooth portion 5 (6) of the die 1 (2) falls within the width of the peak-top portion 7 of the tooth portion 6 (5) of the die 2 (1). Thus, even when opposed axes of the die land the die 2 shift with respect to each other, as long as the end portion 7*a* of the peak-top portion 7 of the tooth portion 5 (6) of the die 1 (2) falls within the width of the peak-top portion 7 of the tooth portion 6 (5) of the die 2 (1), the tooth portion 5 of the die 1 and the tooth portion 6 of the die 2 can be reliably meshed with each other (refer to FIG. 7).

An overlapping width C of the peak-top portions 7 of the tooth portion 5 of the die 1 and the tooth portion 6 of the die 2 varies in accordance with the shift of the opposed axes of the die 1 and the die 2. A large compressive force is applied to the paper sheets 15 when the overlapping width C is large, and a small compressive force is applied to the paper sheets 15 when the overlapping width C is small. Therefore, through an intentional shift of the opposed axes of the die 1 and the die 2 with respect to each other, the compressive force to be applied to the paper sheets 15 can be arbitrarily controlled.

Still further, in the first embodiment, on each of the opposed surfaces 3 and 4 of the dies 1 and 2, on which the respective tooth portions 5 and 6 are formed, the flat surface 11 substantially flush with the valley-bottom portion 8 of each of the tooth portions 5 and 6 is formed on the inclined-surface portion 9 side of each of the tooth portions 5 and 6 and on both the sides in the direction in which the tooth portions 5 and 6 are provided in series. Thus, when a large number of paper sheets 15 are stacked, the stacked paper sheets 15 are pressed with the flat surfaces 11, and hence excessive pressure to the paper sheets 15 from the tooth portions 5 and 6 can be regulated. As a result, the paper sheets 15 can be prevented or suppressed from being torn by the excessive pressure (refer to FIG. 9).

Yet further, in the first embodiment, the end portions 7*a* and 7*b* on both the widthwise sides of the peak-top portion 7 and the end portions 8*a* and 8*b* on both the widthwise sides of the valley-bottom portion 8 of each of the tooth portions 5 and 6 are each formed into a curved-surface shape. In addition, the side surfaces of each of the tooth portions 5 and 6, in other words, the corner portions 14 formed of the inclined-surface portion 9, the opposite surface portion 10, and the side-wall surface portions 13 are also formed into a curved-surface shape. Thus, when the tooth portions 5 and 6 of the dies 1 and 2 are meshed with each other, pressure is dispersed by the curved-surface shape. As a result, the paper sheets 15 can be effectively prevented or suppressed from being torn by the end portions 7*a* and 7*b* on both the widthwise sides of the peak-top portion 7 and the end portions 8*a* and 8*b* on both the widthwise sides of the valley-bottom portion 8 of each of the tooth portions 5 and 6, at which extremely high pressure is applied to the paper sheets 15.

Figure 11:
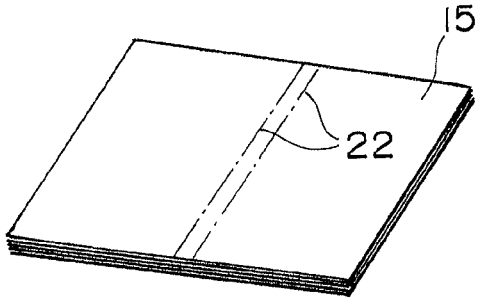
FIG. 11 is a perspective view of a plurality of stacked paper sheets to be compressed with the dies according to the first embodiment.
Figure 12:
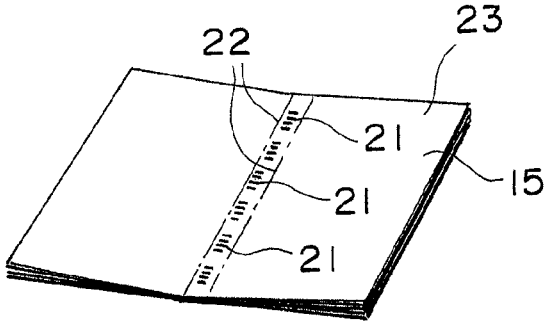
FIG. 12 is a perspective view of a booklet created by compression and binding with the pair of dies according to the first embodiment.

Description is made of an example in which the plurality of paper sheets 15 is bound to create a booklet with use of the dies 1 and 2 according to the first embodiment. First, the plurality of paper sheets 15 to be created as a booklet is stacked. Bending lines 22 and 22 are formed parallel to each other at a predetermined interval on the stacked paper sheets 15 (refer to FIG. 11). The bound portions 21 are formed by securely meshing the tooth portions 5 of the die 1 and the tooth portions 6 of the die 2 with each other from both sides of the stacked paper sheets 15 between the bending lines 22 and 22 and along the bending lines 22 and 22. In this way, the plurality of paper sheets 15 are bound by the bound portions 21 to be created as a booklet 23 (refer to FIG. 12).

Figure 13:
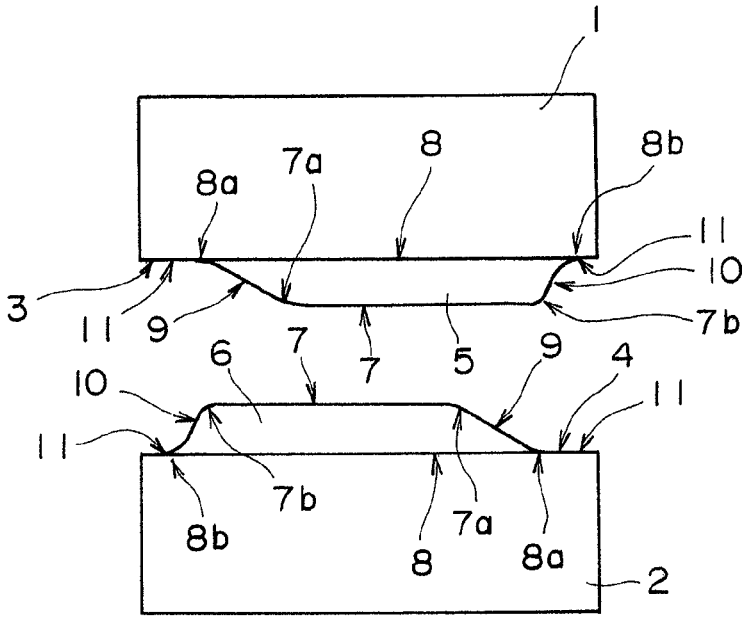
FIG. 13 is a side view illustrating a paper sheet binding die set according to a second embodiment of the present invention.
Figure 14:
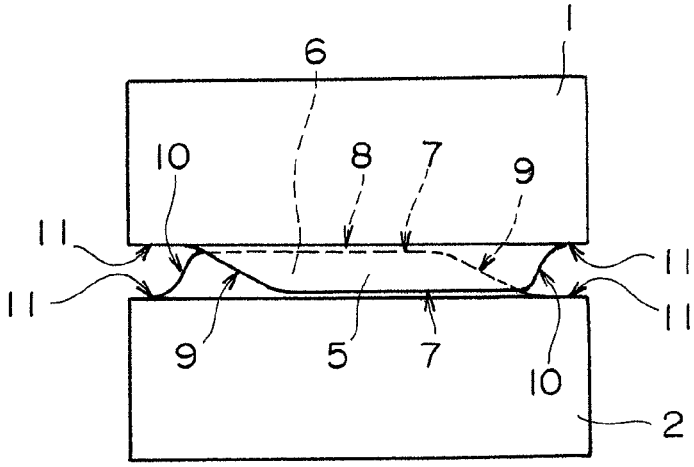
FIG. 14 is a front view illustrating a state in which tooth portions of a pair of dies according to the second embodiment are meshed with each other.
Figure 15:
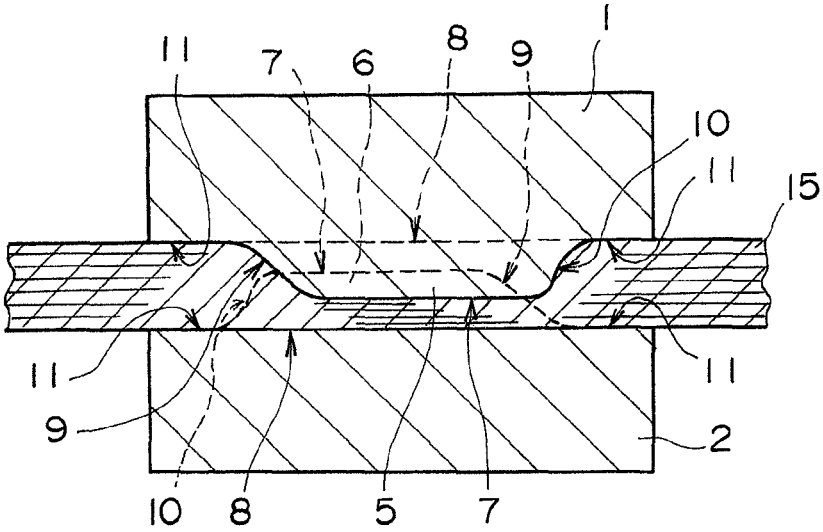
FIG. 15 is a vertical sectional view taken along a width direction of the tooth portions, illustrating a state in which paper sheets are compressed with the dies according to the second embodiment.

FIGS. 13 to 14 illustrate a paper sheet binding die set according to a second embodiment of the present invention. FIG. 13 is a side view illustrating the paper sheet binding die set according to the second embodiment. FIG. 14 is a front view illustrating a state in which tooth portions of a pair of dies according to the second embodiment are meshed with each other. FIG. 15 is a vertical sectional view taken along a width direction of the tooth portions, illustrating a state in which paper sheets are compressed with the dies according to the second embodiment.

The paper sheet binding die set according to the second embodiment basically has the same structure as that in the first embodiment described above. In FIGS. 13 to 14, parts corresponding to those in the first embodiment described above are denoted by the same reference symbols, and description thereof is omitted.

Similarly to the first embodiment described above, the paper sheet binding die set according to the second embodiment includes the pair of dies 1 and 2 arranged to face each other. The opposed surfaces 3 and 4 of the dies 1 and 2 are respectively provided with the tooth portions 5 and 6 capable of meshing with each other. The tooth portions 5 and 6 each have a substantially triangular shape in cross section and a predetermined tooth width, and a plurality of tooth portions are provided in series on a corresponding one of the respective opposed surfaces.

Of the tooth portions 5 and 6 formed as described above, in the second embodiment, similarly to the first embodiment described above, the tooth portion 5 of the one die 1 includes, on the one widthwise side, the inclined-surface portion 9 inclined in a narrowing direction toward the peak-top portion 7 of the tooth portion 5. Further, the tooth portion 6 of the die 2 includes, on the one widthwise side, the inclined-surface portion 9, which is formed on the diagonal side with respect to the above-mentioned inclined-surface portion 9 of the tooth portion 5 of the die 1. Still further, the peak-top portion 7 of the tooth portion 5 of the die 1 exists up to a position at which the peak-top portion 7 of the tooth portion 5 of the die 1 covers the end portion 8*a* of the valley-bottom portion 8 on the inclined-surface portion 9 side of the tooth portion 6 of the die 2. In addition, the peak-top portion 7 of the tooth portion 6 of the die 2 exists up to a position at which the peak-top portion 7 of the tooth portion 6 of the die 2 covers the end portion 8*a* of the valley-bottom portion 8 on the inclined-surface portion 9 side of the tooth portion 5 of the die 1.

Further, the surface portion 10 opposite to the inclined-surface portion 9 on the one widthwise side of each of the tooth portions 5 and 6 of the dies 1 and 2 may include a perpendicular surface or an inclined surface as long as the peak-top portion 7 of the tooth portion 5 (6) of the die 1 (2) exists up to the position at which the peak-top portion 7 of the tooth portion 5 (6) of the die 1 (2) covers the valley-bottom portion 8 on the inclined-surface portion 9 side of the tooth portion 6 (5) of the die 2 (1). In the second embodiment, the opposite surface portion 10 is an inclined surface.

The second embodiment is different from the first embodiment only in that, in the second embodiment, on each of the opposed surfaces 3 and 4 of the dies 1 and 2, on which the respective tooth portions 5 and 6 are formed, the flat surfaces 11 substantially flush with the valley-bottom portion 8 of each of the tooth portions 5 and 6 are formed on both the widthwise sides of each of the tooth portions 5 and 6. Other structural details are the same as those in the first embodiment, and hence the description of the first embodiment applies thereto.

According to the paper sheet binding die set according to the second embodiment, which includes the dies 1 and 2 formed as described above, on each of the opposed surfaces 3 and 4 of the dies 1 and 2, on which the respective tooth portions 5 and 6 are formed, the flat surfaces 11 substantially flush with the valley-bottom portion 8 of each of the tooth portions 5 and 6 are formed on both the widthwise sides of each of the tooth portions 5 and 6. Thus, when a large number of paper sheets 15 are stacked, the paper sheets 15 stacked between the flat surfaces 11 are pressed with the flat surfaces 11 formed on both the widthwise sides of each of the tooth portions 5 and 6, and hence excessive pressure to the paper sheets 15 from the tooth portions 5 and 6 can be regulated. As a result, the paper sheets 15 can be effectively prevented or suppressed from being torn by the excessive pressure (refer to FIG. 15).

Other functions and advantages are the same as those in the first embodiment, and hence the description of the first embodiment applies thereto.

Figure 16:
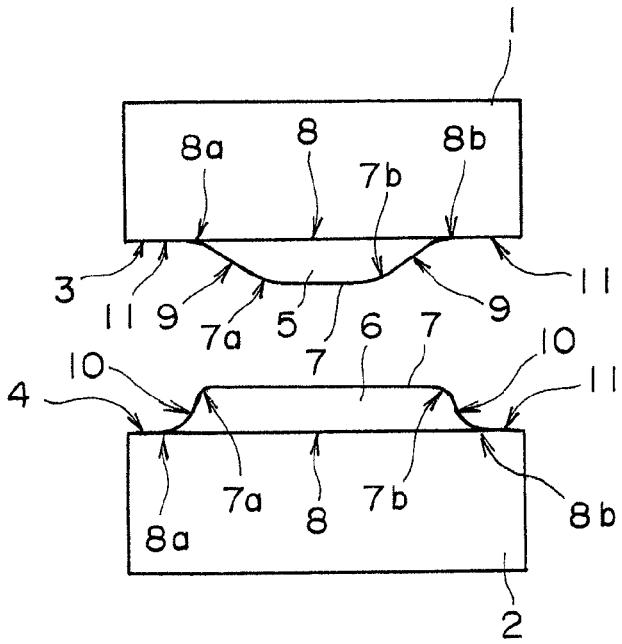
FIG. 16 is a side view illustrating a paper sheet binding die set according to a third embodiment of the present invention.
Figure 17:
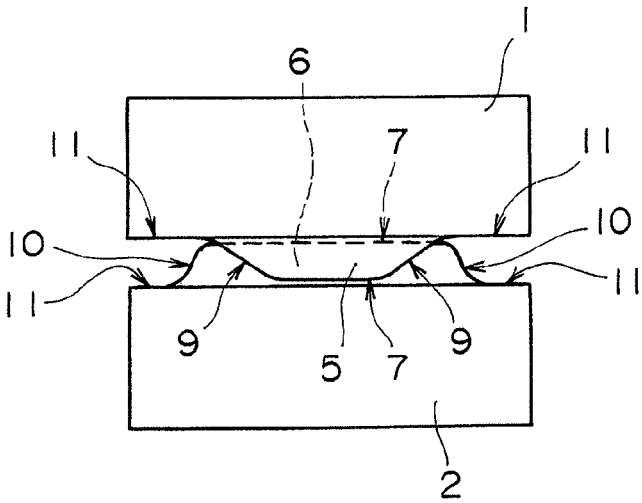
FIG. 17 is a front view illustrating a state in which tooth portions of a pair of dies according to the third embodiment are meshed with each other.

FIGS. 16 and 17 illustrate a paper sheet binding die set according to a third embodiment of the present invention. FIG. 16 is a side view illustrating the paper sheet binding die set according to the third embodiment. FIG. 17 is a front view illustrating a state in which tooth portions of a pair of dies according to the third embodiment are meshed with each other.

The paper sheet binding die set according to the third embodiment basically has the same structure as that in the second embodiment described above. In FIGS. 16 and 17, parts corresponding to those in the second embodiment described above are denoted by the same reference symbols, and description thereof is omitted.

Similarly to the second embodiment described above, the paper sheet binding die set according to the third embodiment includes the pair of dies 1 and 2 arranged to face each other. The opposed surfaces 3 and 4 of the dies 1 and 2 are respectively provided with the tooth portions 5 and 6 capable of meshing with each other. The tooth portions 5 and 6 each have a substantially triangular shape in cross section and a predetermined width, and a plurality of tooth portions are provided in series on a corresponding one of the respective opposed surfaces.

In the third embodiment, of the tooth portions 5 and 6 formed as described above, the tooth portion 5 of the one die 1 includes, on both the widthwise sides, the inclined-surface portions 9 each inclined in the narrowing direction toward the peak-top portion 7 of the tooth portion 5. The peak-top portion 7 of the tooth portion 6 of the die 2 exists up to the position at which the peak-top portion 7 of the tooth portion 6 of the die 2 covers the end portion 8*a* of the valley-bottom portion 8 on the inclined-surface portion 9 sides on both the widthwise sides of the tooth portion 5 of the die 1.

Further, in the third embodiment, the surface portions 10 on both the widthwise sides of the tooth portion 6 of the die 2 are formed as inclined surfaces.

Other structural details are the same as those in the second embodiment, and hence the description of the second embodiment applies thereto.

According to the paper sheet binding die set according to the third embodiment, which includes the dies 1 and 2 formed as described above, the tooth portion 5 of the one die 1 includes, on both the widthwise sides, the inclined-surface portions 9 each inclined in the narrowing direction toward the peak-top portion 7 of the tooth portion 5. Thus, when the tooth portions 5 and 6 of the dies 1 and 2 are meshed with each other, the tooth portions 5 and 6 are meshed with each other on both the widthwise sides with uniform pressure. As a result, stable pressure is applied onto the paper sheets 15, and the tooth portions 5 and 6 of the dies 1 and 2 are easily meshed with each other into the paper sheets 15. Further, the paper sheets 15 can be prevented or suppressed from being torn by meshing the tooth portions 5 and 6 with each other.

Further, in the third embodiment, the tooth portion 5 of the die 1 includes, on both the widthwise sides, the inclined-surface portions 9 each inclined in the narrowing direction toward the peak-top portion 7 of the tooth portion 5. Thus, the width of the peak-top portion 7 of the tooth portion 5 is smaller than the width of the peak-top portion 7 of the tooth portion 6 of the die 2, and the peak-top portion 7 of the tooth portion 5 of the die 1 falls within the width of the peak-top portion 7 of the tooth portion 6 of the die 2. Therefore, even when the opposed axes of the die 1 and the die 2 shift with respect to each other, the tooth portion 5 of the die 1 and the tooth portion 6 of the die 2 can be reliably meshed with each other as long as the peak-top portion 7 of the tooth portion 5 of the die 1 falls within the width of the peak-top portion 7 of the tooth portion 6 of the die 2.

Other functions and advantages are the same as those in the second embodiment, and hence the description of the second embodiment applies thereto.

Figure 18:
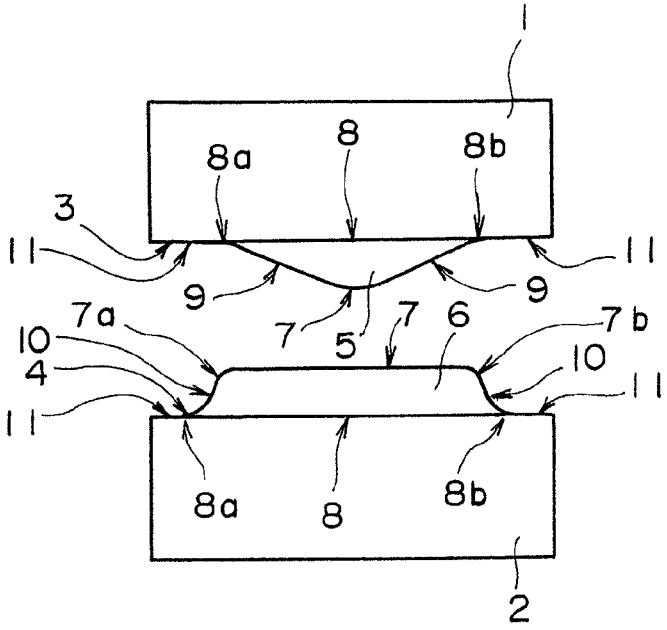
FIG. 18 is a side view illustrating a paper sheet binding die set according to a fourth embodiment of the present invention.
Figure 19:
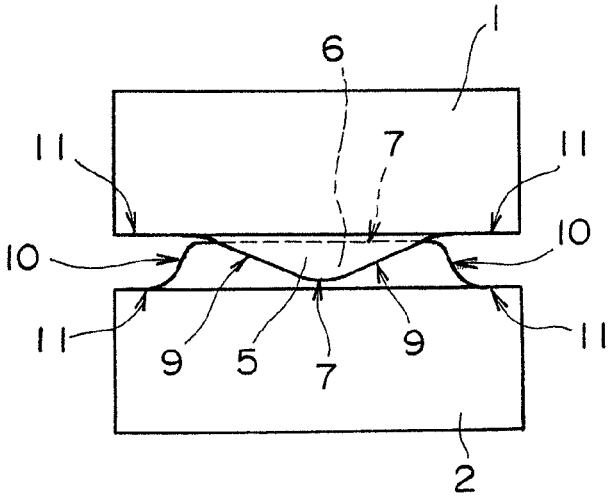
FIG. 19 is a front view illustrating a state in which tooth portions of a pair of dies according to the fourth embodiment are meshed with each other.

FIGS. 18 and 19 illustrate a paper sheet binding die set according to a fourth embodiment of the present invention. FIG. 18 is a side view illustrating the paper sheet binding die set according to the fourth embodiment. FIG. 19 is a front view illustrating a state in which tooth portions of a pair of dies according to the fourth embodiment are meshed with each other.

The paper sheet binding die set according to the fourth embodiment basically has the same structure as that in the third embodiment described above. In FIGS. 18 and 19, parts corresponding to those in the third embodiment described above are denoted by the same reference symbols, and description thereof is omitted.

Similarly to the third embodiment described above, the paper sheet binding die set according to the fourth embodiment includes the pair of dies 1 and 2 arranged to face each other. The opposed surfaces 3 and 4 of the dies 1 and 2 are respectively provided with the tooth portions 5 and 6 capable of meshing with each other. The tooth portions 5 and 6 each have a substantially triangular shape in cross section and a predetermined tooth width, and a plurality of tooth portions are provided in series on a corresponding one of the respective opposed surfaces.

In the fourth embodiment, of the tooth portions 5 and 6 formed as described above, the tooth portion 5 of the one die 1 includes, on both the widthwise sides, the inclined-surface portions 9 each inclined in the narrowing direction toward the peak-top portion 7 of the tooth portion 5. Further, in the peak-top portion 7 of the tooth portion 5, a linear portion does not exist in the width direction thereof, and the peak-top portion 7 exhibits a small-circular-arc shape. Further, the peak-top portion 7 of the tooth portion 6 of the die 2 exists up to the position at which the peak-top portion 7 of the tooth portion 6 of the die 2 covers the end portion 8*a* of the valley-bottom portion 8 on the inclined-surface portion 9 sides on both the widthwise sides of the tooth portion 5 of the die 1.

Further, in the fourth embodiment, the surface portions 10 on both the widthwise sides of the tooth portion 6 of the die 2 are formed as inclined surfaces.

Other structural details are the same as those in the third embodiment, and hence the description of the third embodiment applies thereto.

According to the paper sheet binding die set according to the fourth embodiment, which includes the dies 1 and 2 formed as described above, the tooth portion 5 of the one die 1 includes, on both the widthwise sides, the inclined-surface portions 9 each inclined in the narrowing direction toward the peak-top portion 7 of the tooth portion 5. The tooth portion 5 exhibits a substantially triangular shape formed of the inclined-surface portions 9 provided on both the sides thereof, and the peak-top portion 7 thereof exhibits a small-circular-arc shape. Thus, when the tooth portions 5 and 6 of the dies 1 and 2 are meshed with each other, the peak-top portions 7 of the tooth portions 5 easily bite into the paper sheets 15, and the tooth portions 5 and 6 of the dies 1 and 2 are easily meshed with each other into the paper sheets 15.

Other functions and advantages are the same as those in the third embodiment, and hence the description of the third embodiment applies thereto.

Figure 20:
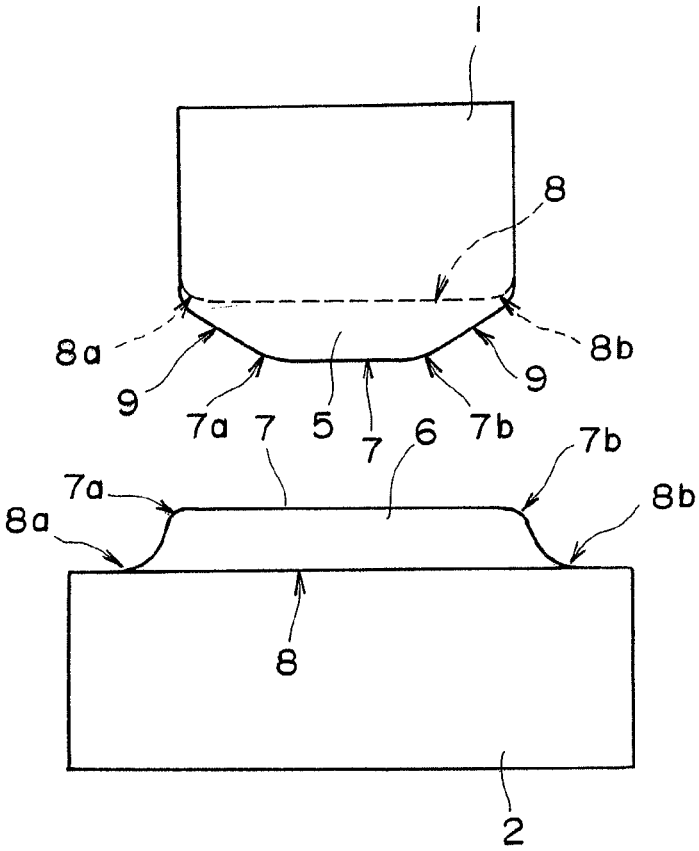
FIG. 20 is a side view illustrating a paper sheet binding die set according to a fifth embodiment of the present invention.
Figure 21:
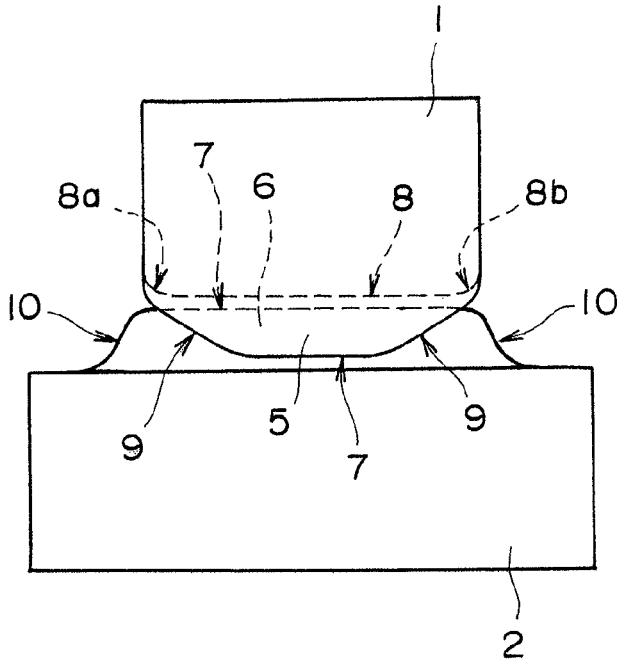
FIG. 21 is a front view illustrating a state in which tooth portions of a pair of dies according to the fifth embodiment are meshed with each other.

FIGS. 20 and 21 illustrate a paper sheet binding die set according to a fifth embodiment of the present invention. FIG. 20 is a side view illustrating the paper sheet binding die set according to the fifth embodiment. FIG. 21 is a front view illustrating a state in which tooth portions of a pair of dies according to the fifth embodiment are meshed with each other.

The paper sheet binding die set according to the fifth embodiment basically has the same structure as that in the third embodiment described above. In FIGS. 20 and 21, parts corresponding to those in the third embodiment described above are denoted by the same reference symbols, and description thereof is omitted.

Similarly to the third embodiment described above, the paper sheet binding die set according to the fifth embodiment includes the pair of dies 1 and 2 arranged to face each other. The opposed surfaces 3 and 4 of the dies 1 and 2 are respectively provided with the tooth portions 5 and 6 capable of meshing with each other. The tooth portions 5 and 6 each have a substantially triangular shape in cross section and a predetermined tooth width, and a plurality of tooth portions are provided in series on a corresponding one of the respective opposed surfaces.

Similarly to the third embodiment described above, in the fifth embodiment, of the tooth portions 5 and 6 formed as described above, the tooth portion 5 of the one die 1 includes, on both the widthwise sides, the inclined-surface portions 9 each inclined in the narrowing direction toward the peak-top portion 7 of the tooth portion 5. The peak-top portion 7 of the tooth portion 6 of the die 2 exists up to the position at which the peak-top portion 7 of the tooth portion 6 of the die 2 covers the end portion 8*a* of the valley-bottom portion 8 on the inclined-surface portion 9 sides on both the widthwise sides of the tooth portion 5 of the die 1.

Further, in the fifth embodiment, the surface portions 10 on both the widthwise sides of the tooth portion 6 of the die 2 are formed as inclined surfaces.

The fifth embodiment is different from the third embodiment in that, in the fifth embodiment, on the opposed surface 3 of the die 1, on which the tooth portions 5 are formed, each tooth portion 5 is not provided with the flat surfaces on both the widthwise sides. Instead, in the fifth embodiment, each of the end portions 8*a* and 8*b* on both the widthwise sides of the valley-bottom portion 8 of the tooth portion 5 of the die 1 is formed into a curved-surface shape.

Other structural details are the same as those in the third embodiment, and hence the description of the third embodiment applies thereto.

According to the paper sheet binding die set according to the fifth embodiment, which includes the dies 1 and 2 formed as described above, each of the end portions 8*a* and 8*b* on both the widthwise sides of the valley-bottom portion 8 of the tooth portion 5 of the die 1 is formed into a curved-surface shape. Thus, when the tooth portions 5 and 6 of the dies 1 and 2 are meshed with each other, pressure from the end portions 8*a* and 8*b* on both the widthwise sides of the valley-bottom portion 8 of the tooth portion 5 of the die 1 is dispersed by the curved-surface shape. As a result, the paper sheets 15 can be prevented or suppressed from being torn by meshing the tooth portions 5 and 6 with each other.

Other functions and advantages are the same as those in the third embodiment, and hence the description of the third embodiment applies thereto.

Figure 22:
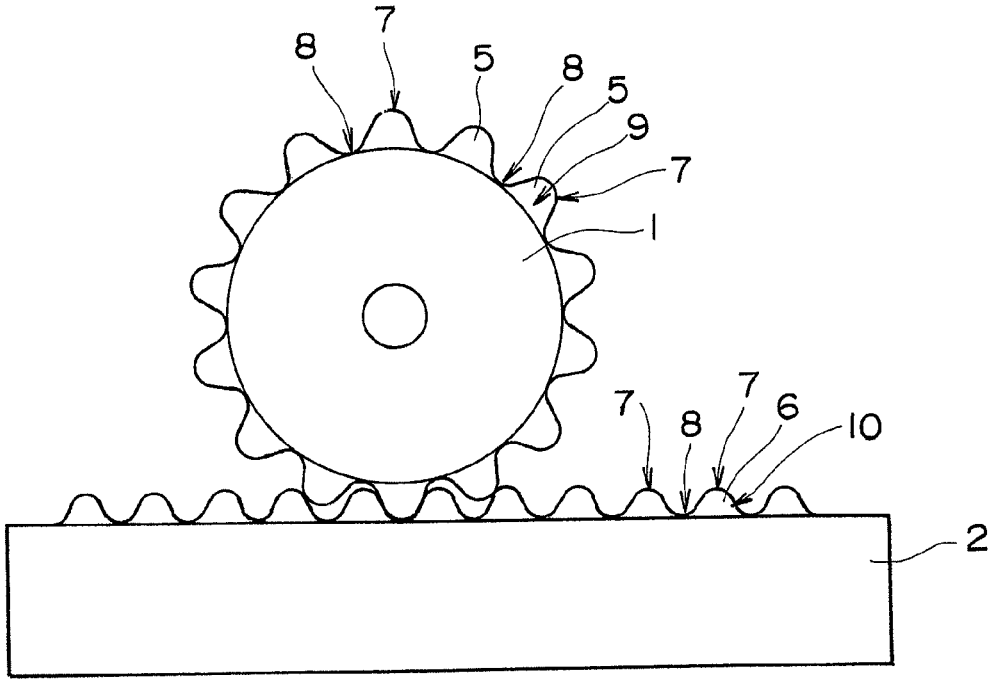
FIG. 22 is a front view illustrating a paper sheet binding die set according to a sixth embodiment of the present invention.

FIG. 22 is a front view illustrating a paper sheet binding die set according to a sixth embodiment of the present invention.

The paper sheet binding die set according to the sixth embodiment basically has the same structure as that in the third embodiment described above. In FIG. 22, parts corresponding to those in the third embodiment described above are denoted by the same reference symbols, and description thereof is omitted.

Similarly to the first embodiment described above, the paper sheet binding die set according to the sixth embodiment includes the pair of dies 1 and 2 arranged to face each other. The opposed surfaces 3 and 4 of the dies 1 and 2 are respectively provided with the tooth portions 5 and 6 capable of meshing with each other. The tooth portions 5 and 6 each have a substantially triangular shape in cross section and a predetermined tooth width, and a plurality of tooth portions are provided in series on a corresponding one of the respective opposed surfaces.

Of the tooth portions 5 and 6 formed as described above, in the sixth embodiment, similarly to the first embodiment described above, the tooth portion 5 of the one die 1 includes, on the one widthwise side, the inclined-surface portion 9 inclined in the narrowing direction toward the peak-top portion 7 of the tooth portion 5. Further, the tooth portion 6 of the die 2 includes, on the one widthwise side, the inclined-surface portion 9, which is formed on the diagonal side with respect to the above-mentioned inclined-surface portion 9 of the tooth portion 5 of the die 1. Still further, the peak-top portion 7 of the tooth portion 5 of the die 1 exists up to a position at which the peak-top portion 7 of the tooth portion 5 of the die 1 covers the valley-bottom portion 8 on the inclined-surface portion 9 side of the tooth portion 6 of the die 2. In addition, the peak-top portion 7 of the tooth portion 6 of the die 2 exists up to a position at which the peak-top portion 7 of the tooth portion 6 of the die 2 covers the valley-bottom portion 8 on the inclined-surface portion 9 side of the tooth portion 5 of the die 1.

Further, the surface portion 10 opposite to the inclined-surface portion 9 on the one widthwise side of each of the tooth portions 5 and 6 of the dies 1 and 2 may include a perpendicular surface or an inclined surface as long as the peak-top portion 7 of the tooth portion 5 (6) of the die 1 (2) exists up to the position at which the peak-top portion 7 of the tooth portion 5 (6) of the die 1 (2) covers the valley-bottom portion 8 on the inclined-surface portion 9 side of the tooth portion 6 (5) of the die 2 (1). In the sixth embodiment, the opposite surface portion 10 is an inclined surface.

In the sixth embodiment, of the dies 1 and 2, the one die 1 has a gear shape, and the another die 2 has a linear shape. Further, in the sixth embodiment, the tooth portions 5 and 6 are endlessly provided in series to the gear-shaped die 1, and the flat surface is not provided in the direction in which the tooth portions 5 are provided in series. Other structural details are the same as those in the first embodiment, and hence the description of the first embodiment applies thereto.

According to the paper sheet binding die set according to the sixth embodiment, which includes the dies 1 and 2 formed as described above, of the dies 1 and 2, the one die 1 has a gear shape, and the another die 2 has a linear shape. Thus, the paper sheets 15 can be bound through rotation of the gear-shaped die 1 and movement of the gear-shaped die 1 or the linear-shaped die 2. In this way, the dies 1 and 2 according to the sixth embodiment pressurize and compress the paper sheets 15 through reciprocating movement. Thus, contacts of meshing are partial, and hence surface pressure is considerably reduced. Further, variation of ranges (dimensions) of points to be bound can be easily coped with. In addition, the dies 1 and 2 generate less noise at the time of pressing. Other functions and advantages are the same as those in the third embodiment, and hence the description of the third embodiment applies thereto.

REFERENCE SIGNS LIST

1, 2 die
3, 4 opposed surface
5, 6 tooth portion
7 peak-top portion
7*a*, 7*b* end portion of peak-top portion
8 valley-bottom portion
8*a*, 8*b* end portion of valley-bottom portion
9 inclined-surface portion
10 surface portion
11 flat surface
13 side-wall surface portion
14 corner portion
15 paper sheet
16 compressed portion
17 peak portion
18 valley portion
19 inclined surface
20 compression imprint
21 bound portion
22 bending line
23 booklet

The invention claimed is:

1. A paper sheet binding die set, comprising:

a first die and a second die, each having an opposed surface comprising a plurality of tooth portions;

wherein the first die and the second die are configured to face each other such that the plurality of tooth portions of the first die and the plurality of tooth portions of the second die are capable of meshing with each other;

wherein each of the plurality of tooth portions of the first die has a substantially triangular cross section and a predetermined width, is provided in series on the opposed surface of the first die, and each comprises a bottom portion, a peak-top portion, and an inclined-surface portion extending at an incline from an edge of the bottom portion to a point on the peak-top portion on a lateral side of the respective tooth portion;

wherein each of the plurality of tooth portions of the second die has a substantially triangular cross section and a predetermined width, is provided in series on the opposed surface of the second die, and each comprises a bottom portion, a peak-top portion, and an inclined-surface portion extending at an incline from an edge of the bottom portion to a point on the peak-top portion on a lateral side of the respective tooth portion;

wherein the peak-top portion of each of the plurality of tooth portions of the first die has a length so as to extend over and beyond at least a part of the inclined-surface portion of a corresponding one of the plurality of tooth portions of the second die upon meshing of the first die and the second die; and wherein the paper sheet binding die set is configured to bind a plurality of stacked paper sheets such that the first die and the second die pressurize the plurality of stacked paper sheets from respective opposing sides of the plurality of stacked paper sheets.

2. The paper sheet binding die set according to claim 1, wherein the opposed surface of one of the first die and the second die comprises a flat surface on a lateral side of the respective die, the flat surface being substantially flush with the bottom portion of each of the plurality of tooth portions of the respective die.

3. The paper sheet binding die set according to claim 2, wherein ends of the peak-top portion of each of the plurality of tooth portions of one of the first die and the second die are formed into a curved-surface shape, and ends of the bottom portion of each of the plurality of tooth portions of the one of the first die and the second die are formed into a curved-surface shape.

4. The paper sheet binding die set according to claim 2, wherein one of the first die and the second die has a gear shape, and the other of the first die and the second die has a linear shape.

5. The paper sheet binding die set according to claim 1, wherein ends of the peak-top portion of each of the plurality of tooth portions of one of the first die and the second die are formed into a curved-surface shape, and ends of the bottom portion of each of the plurality of tooth portions of the one of the first die and the second die are formed into a curved-surface shape.

6. The paper sheet binding die set according to claim 5, wherein one of the first die and the second die has a gear shape, and the other of the first die and the second die has a linear shape.

7. The paper sheet binding die set according to claim 1, wherein one of the first die and the second die has a gear shape, and the other of the first die and the second die has a linear shape.

* * * * *